United States Patent [19]

Booe, Jr.

[11] 4,392,264

[45] Jul. 12, 1983

[54] COMBINATION TOOL FOR REMOVING AND REPLACING A NUT

[76] Inventor: James M. Booe, Jr., 7812 E. Vermont St., Indianapolis, Ind. 46219

[21] Appl. No.: 238,211

[22] Filed: Feb. 26, 1981

[51] Int. Cl.[3] ..... B25B 27/00; B25F 1/04

[52] U.S. Cl. ..... 7/138; 81/10; 81/169; 29/267

[58] Field of Search ..... 7/138, 169; 81/3.46 R, 81/3 R, 10; 29/267, 283.5; 254/131; D8/26

[56] References Cited

U.S. PATENT DOCUMENTS

| | | | |
|---|---|---|---|
| 657,075 | 9/1900 | Ball | 81/10 |
| 904,572 | 11/1908 | Swain | 7/169 |
| 1,040,564 | 10/1912 | Merrill | 81/3.46 R |
| 2,898,674 | 8/1959 | Anderson | 7/169 |
| 3,623,172 | 11/1971 | Hall | 7/138 |
| 3,793,656 | 2/1974 | Songer et al. | 254/131 |
| 4,089,077 | 5/1978 | Morton | D8/26 |

*Primary Examiner*—Roscoe V. Parker

*Attorney, Agent, or Firm*—Barnes & Thornburg

[57] ABSTRACT

A combination tool comprises an elongated lever having a handle at one end, two divergent fingers at the other end, and an aperture between the two ends adapted for engagement with a nut. One of the fingers includes a distal end and claw in spaced relationship thereto which cooperate to provide a fulcrum for movement of the lever, thereby to facilitate the removal and replacement of nuts which are locked on a threaded shaft by a locking member having bendable tabs projecting outwardly therefrom.

6 Claims, 5 Drawing Figures

COMBINATION TOOL FOR REMOVING AND REPLACING A NUT

The present invention relates to hand tools adapted for use in confined spaces, and more particularly, to a tool for facilitating the removal and replacement of a propeller which is mounted on a threaded drive shaft within the confines of a shroud.

Various tools have been developed for use in removing and replacing a nut which is locked on a threaded shaft in a confined space by a locking member having bendable tabs projecting outwardly therefrom. One particular application for such tools is in the removal and replacement of a propeller mounted on a threaded drive shaft of a boat engine. Generally, the propeller is mounted to the shaft by a nut which is locked on the shaft by a locking member having bendable tabs. The nut and locking member are secured to the shaft in the confined space of a shroud which carries the propellers and encompasses the shaft.

Tools particularly adapted for performing such operations in connection with motor boat engines are disclosed in U.S. Pat. Nos. 3,623,172 and 4,089,077. While such tools facilitate the task of removing and replacing propellers, they still have various deficiencies. For example, the structure and method of operation of both of the tools disclosed in these patents make it possible for them to disengage when bending one of the tabs of the locking member. The wrench portion of each of the tools disclosed in these patents is located in proximity to an end so that the tool must be reversed or rotated in order to use the wrench portion. No single handle portion is provided for use in performing all functions of the tool. Further, while these tools provide some mechanical advantage for bending the tabs of the locking member, considerable force must still be exerted on the tool to perform the bending operations.

Other combination tools are disclosed in U.S. Pat. Nos. 657,075; 904,572; and 2,898,674; however, none of these tools suggest ways to effectively improve the tools disclosed in U.S. Pat. Nos. 3,623,172 and 4,089,077.

One object of the present invention is to provide an improved combination tool which may be used more efficiently in removing and replacing propellers fixed to drive shafts of boat motors.

Another object of the present invention is to provide an improved combination tool that is simple in construction, economically and commercially feasible to manufacture, and durable and reliable in operation.

A further object of the present invention is to provide an improved combination tool which is a single rigid unit and where the structure and method of operation of the tool effectively increase its stability in relation to prior tools.

Yet another object of the present invention is to provide an improved combination tool where the force needed to perform the bending operations is effectively decreased through a novel arrangement which increases the mechanical advantage in relation to prior tools.

In one illustrative embodiment, the combination tool of the present invention comprises an elongated lever having a first end section including a handle, a second end section including first and second divergent fingers, and a wrench section interposed between the two end sections. A first finger includes a generally planar end and a claw extension adjacent to the planar end for engaging upper and lower surfaces, respectively, of one of the tabs of a locking member. The planar end of the first finger, in cooperation with the upper surface of the one tab, provides a fulcrum for movement of the lever, thereby to bend the one tab upward. A second finger projects outwardly slightly further than the claw extension of the first finger for engaging an upper surface of the one tab. The planar end of the first finger, in cooperation with the upper and lower surfaces of a tab opposed to the one tab provides a fulcrum for movement of the lever, thereby to bend the one tab downward.

Other features and advantages of the present invention will become apparent in view of the following detailed description of one embodiment thereof, which description should be considered in conjunction with the accompanying drawings, in which.

Figure 1:
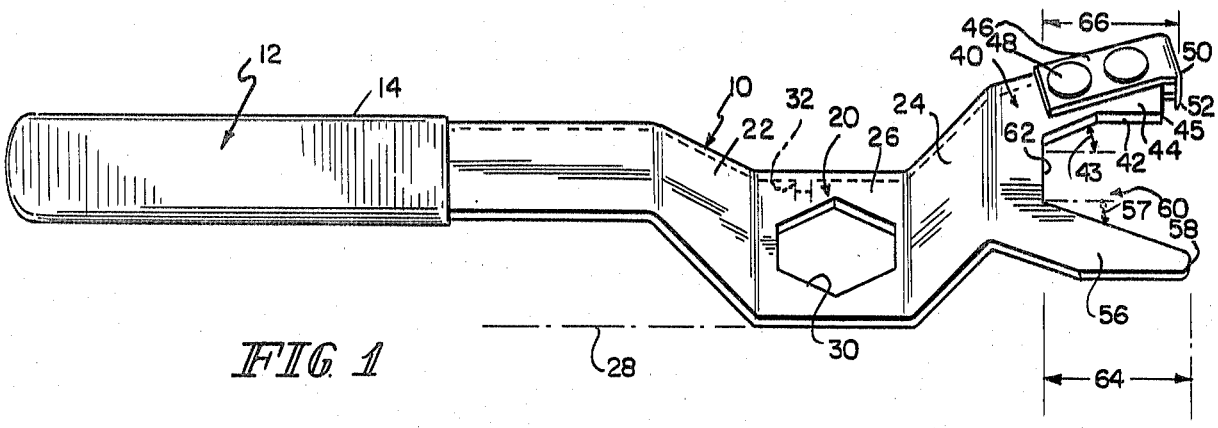
FIG. 1 is an elevational view in perspective of the combination tool constructed according to the present invention.
Figure 3:
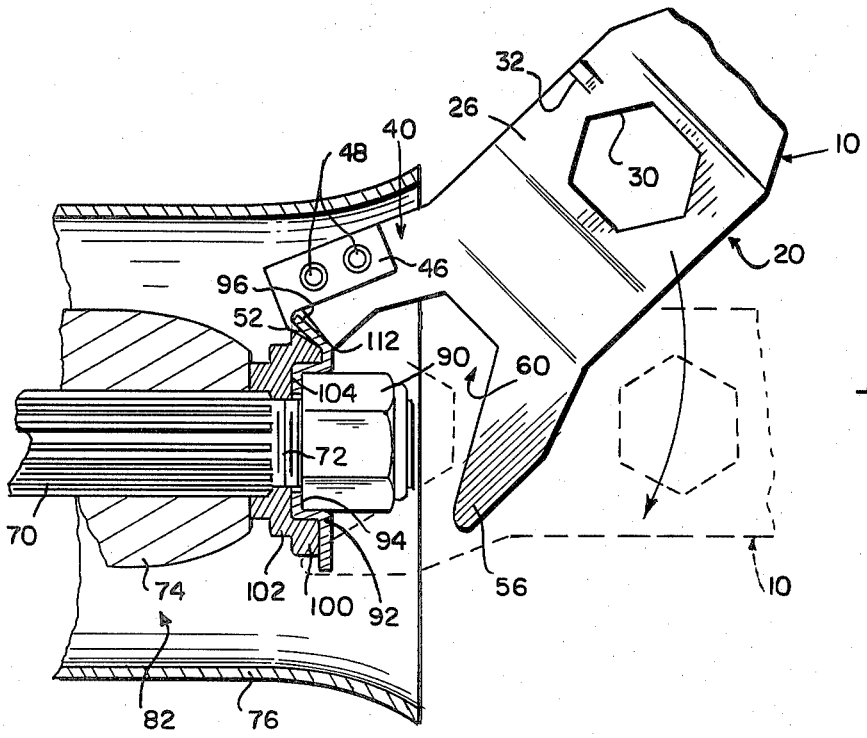
FIG. 3 is a transverse view, partly sectioned, of the housing, propeller, and drive shaft of a boat motor showing the combination tool of FIG. 1 performing a function in connection with removing the propeller from the drive shaft.
Figure 4:
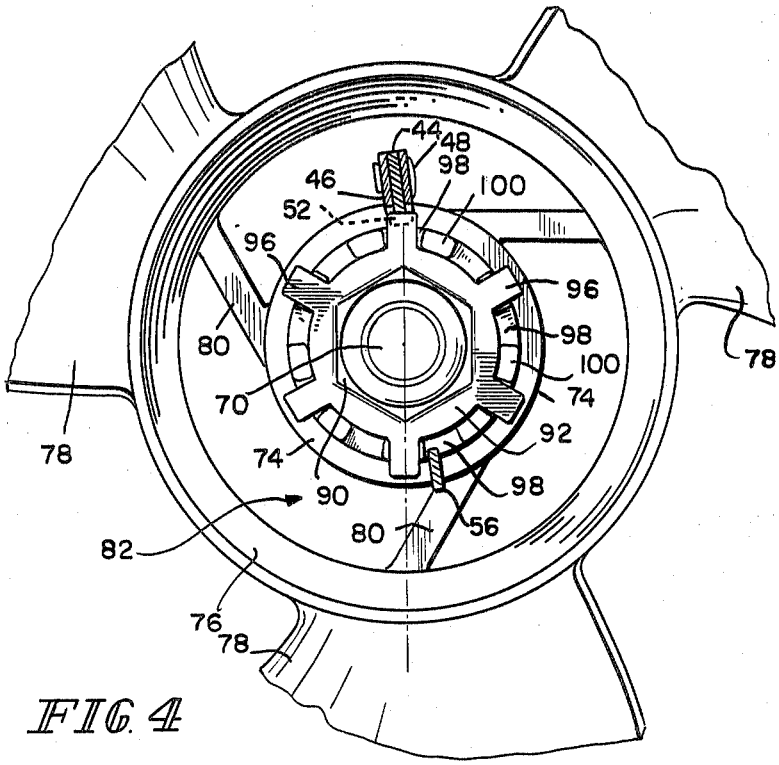
Figure 5:
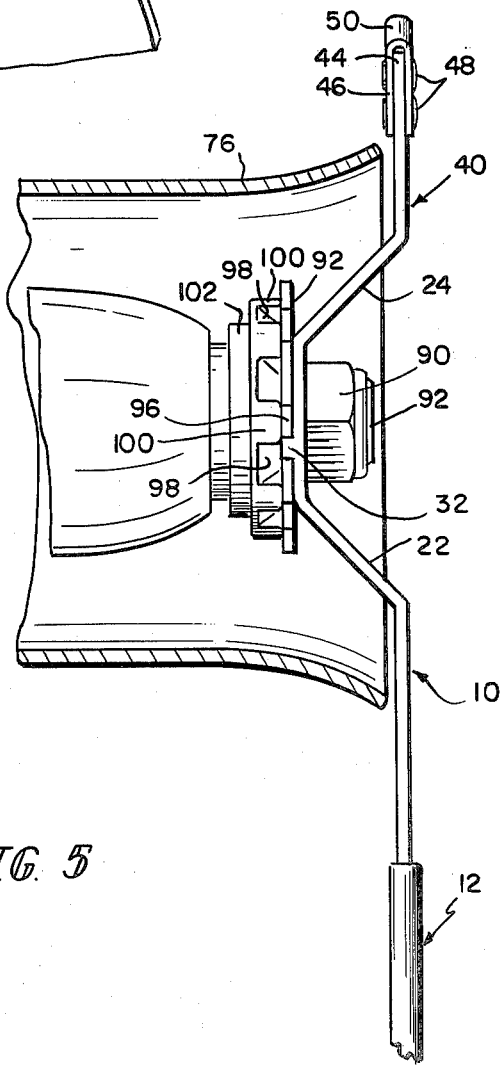

FIG. 4 is a top elevational view, partly sectioned, of the housing, propeller, and drive shaft of a boat motor showing the relative position of the combination tool of FIG. 1 in performing the function shown in FIG. 3; and FIG. 5 is a transverse view, partly sectioned, of the housing, propeller, and drive shaft of a boat motor showing the combination tool of FIG. 1 performing a further function in connection with the removal and replacement of the propeller.

Referring now to FIG. 1, the combination tool of the present invention is an elongated lever 10 which includes a proximal end section 12, a distal end section 40, and a wrench section 20 provided between the two end sections 12, 40. The lever 10 is a single unit which may be fabricated from a rigid material, such as metal, and may be stamped from a sheet of the rigid material as opposed to being cast in a die.

The proximal end section 12 of the lever 10 provides a tang for receiving a grip 14 which is sleeved over the tang to form a handle for manipulation of the tool in performing its several functions. Grip 14 may be fabricated from any flexible material, such as rubber or a soft plastic.

The wrench section 20 is canted from the end sections 12, 40, and is integrally joined thereto by a first web portion 22 which extends angularly downwardly from the proximal end section 12 and a second web portion 24 which extends angularly downwardly from the distal end section 40. As best shown in FIG. 5, the wrench section 20 is offset from the plane of the end sections 12, 40. The wrench section 20 also includes a third web portion 26 which is in a plane 28 in spaced parallel relationship to the plane of the end sections 12, 40. The third web portion 26 includes a hexagon-shaped aperture 30 which lies in the plane 28 and a downwardly projecting alignment detent 32 positioned adjacent to one edge of the third web portion 26. The function of the wrench section 20 will be described in detail in the description of the use and operation of the tool.

Continuing to refer to FIG. 1, the distal end section 40 of the lever 10 includes two outwardly extending divergent fingers 42, 56. The two divergent fingers 42, 56 give the lever 10 a generally Y-shape appearance. A first finger 42 extends outwardly at an angle 43 of generally 30° in relation to the longitudinal axis of the lever 10. The distal end 44 of the finger 42 includes a planar distal surface or edge 45 in a plane at generally a right angle to the longitudinal axis of the lever 10. A finger extension 46 is mounted to the finger 42 by rivets 48 or other well-known connecting means, and extends beyond the outer surface 45. The distal end 50 of the finger extension 46 includes a claw 52 in spaced relationship to the surface 45. For reasons which will become apparent in the description of the use and operation of the tool, the distance between the surface 45 and the claw 52 should be relatively small.

A second finger 56 extends outwardly at an angle 57 of generally 30° in relation to the longitudinal axis of the lever 10. The second finger 56 is tapered toward its distal end 58 and has a generally rounded distal surface.

The two divergent fingers 42, 56 are separated by a generally U-shaped outwardly opening space 60. An intermediate surface 62 integrally joins the two fingers 42, 56 at generally a right angle to the longitudinal axis of the lever 10. Measured from the intermediate surface 62 along the longitudinal axis of the lever 10, the length 64 of the second finger 56 is slightly greater than the combined length of the first finger 42 and finger extension 46. The advantages of each of these features of the tool will become apparent in the description of its use and operation which follows.

The use and operation of the combination tool can best be described by referring to FIGS. 2–5 wherein like reference numerals are used throughout the various views to indicate like parts. The tool of the present invention is particularly adapted for use in confined spaces to remove and replace a nut which is locked on a threaded shaft by a locking member having one or more bendable locking tabs projecting outwardly therefrom. Typically, the tabs of the locking member are bent downwardly into one or more of a plurality of radially extending angularly spaced grooves to prevent turning of the nut after it has been tightened onto the threaded shaft. In order to unlock the nut and allow it to be turned for removal, the tabs must be bent upwardly out of the grooves. In confined spaces, these bending operations are difficult to perform.

One illustrative example of the use for the combination tool is in the removal and replacement of a propeller mounted on a drive shaft of a boat motor where the connection between the propeller and shaft is confined within an encompassing shroud or housing. As shown in FIGS. 2–5, a conventional propeller hub assembly includes a splined drive shaft 70 having its distal end externally threaded and a propeller hub 74 having a splined connection with the shaft 70. This assembly is encompassed by a shroud or housing 76 which is generally cylindrical and carries a plurality of radially outwardly projecting propeller blades 78, as best shown in FIG. 4. The shroud 76 is connected in spaced relationship to the propeller hub 74 by braces 80 and completely surrounds the propeller hub assembly so that the shaft 70 and propeller hub 74 are located within a relatively limited space 82 defined by the shroud 76.

The propeller hub 74 is secured to the propeller drive shaft 70 by an internally threaded hexagon-shaped nut 90 which threadably engages the threaded distal end 72 of the drive shaft 70. The nut 90 is locked in place after it is tightened to prevent removal of the propeller hub 74 by a lock washer 92 having a hexagon-shaped depression 94 for receiving the hexagon-shaped nut 90. The lock washer 92 includes a plurality of outwardly projecting bendable tabs 96, each adapted to be bent into one of a plurality of radially disposed, angularly spaced grooves 98 formed between castellated portions 100 of a splined washer 102 which has a splined connection with the drive shaft 70 and which bears against the propeller hub 74. The splined washer 102 includes a circular-shaped depression 104 for receiving the lock washer 92 so that it may rotate freely relative to the splined washer 102 until a tab 96 is bent into one of the grooves 98.

Figure 2:
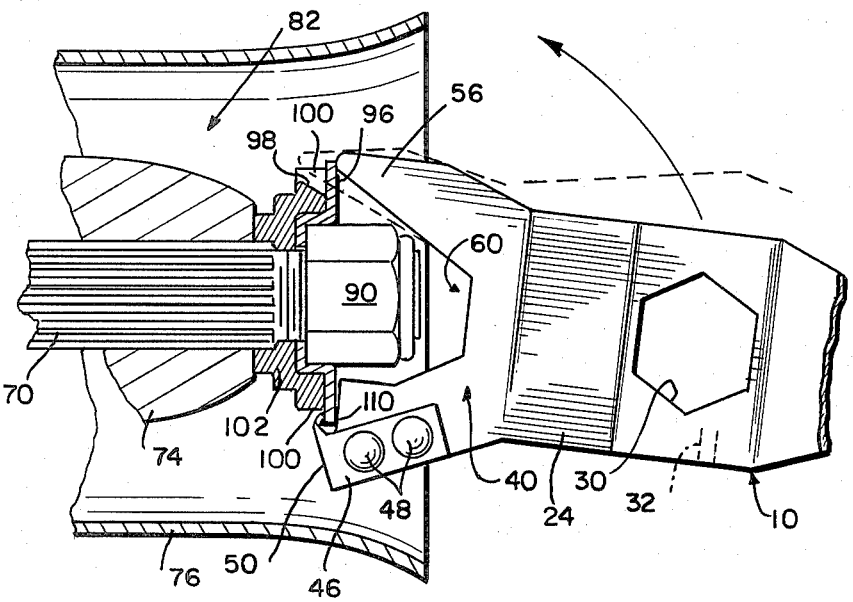
FIG. 2 is a transverse view, partly sectioned, of the housing, propeller, and drive shaft of a boat engine showing the combination tool of FIG. 1 performing a function in connection with mounting the propeller on the drive shaft.

Referring particularly to FIGS. 2 and 5, when it is desired to assemble or replace the lock washer 92 and nut 90 on the drive shaft 70, the lock washer 92 is positioned in the circular-shaped depression 104 of the splined washer 102, and the nut 90 is threaded onto the drive shaft 70 with the wrench section 20 of the lever 10. Since the wrench section 20 is canted from the end sections 12, 40 of the lever 10, it effectively engages the nut 90 within the space 82 defined by the shroud 76, and the ends 12, 40 are elevated external to the shroud 76 to allow unobstructed rotational movement of the lever 10 in a clockwise direction for tightening the nut 90 onto the drive shaft 70.

As the nut 90 is tightened onto the drive shaft 70, it is important that the hexagon-shaped nut 90 be properly aligned with the hexagon shape of the depression 94 in the lock washer 92 in order to lock the nut 90 on the shaft 70. The downwardly projecting alignment detent 32 adjacent the edge of the wrench section 20 of the lever 10 serves to align the nut 90 with the depression 94 as the lever 10 is rotated to tighten the nut 90 on the shaft 70. The alignment detent 32 is positioned relative to the hexagon-shaped aperture 30 in the wrench section 20, so that as the lever 10 is rotated, the detent 32 engages one of the outwardly projecting tabs 96 of the lock washer 92 to align the hexagon-shaped aperture 30 with the hexagon-shaped depression 94 of the lock washer 92. Further rotation of the lever 10 with the alignment detent 32 engaging a tab 96 of the lock washer 92 causes the nut 90 and lock washer 92 to be rotated simultaneously with the aperture 30 and depression 94 properly aligned so that the nut 90 is positioned in the depression 94 as it is being tightened onto the shaft 70.

After the nut 90 has been tightened onto the drive shaft 70, selected tabs 96 of the lock washer 92 are bent downwardly into associated grooves 98 on the splined washer 102 in the manner shown in FIG. 2. By hooking the claw 52 of the finger extension 46 on the lower surface of a tab 96 diametrically opposed to the selected tab 96 so that the planar distal surface 45 of the finger 42 engages the upper surface of the opposed tab 96, a fulcrum 110 is provided between the finger 42 and the opposed tab 96 for movement of the lever 10. As the lever is moved in the direction of the arrow in FIG. 2, the second finger 56 engages the selected tab 96 so that further movement of the lever 10 bends the selected tab 96 downwardly into an associated groove 98 of the splined washer 102. The entire lever 10 pivots about the fulcrum 110 formed by the engagement of the finger 42 with the upper surface of the diametrically opposed tab 96. It should be noted that the outwardly opening space 60 separating the fingers 42, 56 is large enough to receive the nut 90 during the movement of the lever 10. During the bending operation, the lever 10 does not engage either the shaft 70 or the nut 90. This operation is repeated with each selected tab 96 of the lock washer 92 to lock the nut 90 against rotation once it has been tightened onto the drive shaft 70.

In order to remove the nut 90 from the propeller shaft 70, it is necessary to straighten each downwardly bent tab 96 of the lock washer 92 by bending it upwardly so that the tabs 96 are disposed in a plane substantially parallel to the axis of rotation of the nut 90.

As shown in FIGS. 3 and 4, the tabs 96 may be bent upwardly or straightened by inserting the claw 52 of the finger extension 46 against the lower surface of a downwardly bent tab 96 so that the planar distal surface 45 of the finger 42 engages the upper surface of the downwardly bent tab 96. The cooperation between the planar surface 45 of finger 42 and the upper surface of the downwardly bent tab 96 provides a fulcrum 112 for movement of the lever 10 in the direction of the arrow in FIG. 3. The entire lever therefore pivots about the fulcrum point 112. During this bending operation, the lever 10 does not engage either the shaft 70 or the nut 90. Since the distance between the fulcrum point 112 and the claw 52 of the finger extension 46 is substantially less than the distance between the fulcrum point 112 and the handle 14 of the lever 10, the mechanical advantage for prying the tab 96 upwardly is significantly greater than conventional tools adapted for the same purpose. Therefore, less force is required to move the lever 10 and bend the tab 96 upwardly.

As shown in FIG. 4, it may be desirable to radially offset the second finger 56 from the tab 96 diametrically opposed to the downwardly bent tab 96 being pried upwardly to assure that the downwardly bent tab 96 is completely straightened and disposed in the plane substantially parallel to the axis of rotation of the nut 90. It should be noted that the downwardly bent tab 96 may be effectively straightened without offsetting the second finger 56; however, the offset position of the second finger 56 is a preferred position in performing the prying operation of the tool.

Once each of the downwardly bent tabs 96 have been bent upwardly and straightened so that they are adjacent the end surface of the splined washer 102, the nut 90 may be unscrewed from the drive shaft 70 by again engaging the wrench section 20 of the lever 10 with the nut 90 and rotating the lever 10 in a counterclockwise direction to remove the nut 90 from the drive shaft 70.

What is claimed is:

1. A combination tool for use in removing and replacing a nut which is locked on a threaded shaft by a locking member having bendable locking tabs projecting outwardly therefrom, the tool comprising an elongated lever having a proximal end section including a handle, a distal end section including a first finger for engaging and bending one tab upward upon movement of the lever, and a second finger for engaging and bending an opposing tab downward, the two fingers being separated by an outwardly opening space, and a wrench section interposed between the two end sections for engaging the nut, the first finger including means for engaging both upper and lower surfaces of the one tab, thereby to provide a fulcrum for the movement of the lever to bend the one tab upward and the opposing tab downward.

2. The tool as recited in claim 1 wherein the second finger extends slightly further outwardly than the first finger for engaging an upper surface of the opposing tab, thereby to bend the opposing tab downward upon movement of the lever.

3. The tool as recited in claim 1 wherein the end sections are provided in the same plane and the wrench section is offset from the plane of the end sections and integrally joined thereto by web portions.

4. The tool as recited in claim 3 wherein the wrench section includes an aperture which is adapted for engagement with the nut and a downwardly projecting alignment detent for engaging the locking member, thereby to align and simultaneously move the nut and locking member upon rotational movement of the lever to tighten the nut on the shaft.

5. A combination tool for use in removing and replacing propellers which are mounted on a propeller drive shaft by a nut and a locking member having bendable locking tabs projecting therefrom, the tool comprising an elongated lever having a proximal end section including a handle, a distal end section including first and second divergent fingers, and a wrench section interposed between the end sections, the first finger including a distal end for engaging an upper surface of a selected tab and a claw in spaced relationship to the end of the first finger for engaging a lower surface of the selected tab, the engagement of the distal end of the first finger and the upper surface of the selected tab providing a fulcrum for movement of the lever, thereby to bend the first tab upward, the second finger extending slightly beyond the first finger for engaging an upper surface of the selected tab, engagement of the distal end of the first finger and an upper surface of a tab opposed to the selected tab providing a fulcrum for movement of the lever, thereby to bend the selected tab downward.

6. A combination tool for removing and replacing a propeller mounted to the drive shaft of a boat engine by a nut and a locking member having bendable locking tabs projecting therefrom, comprising a generally Y-shaped lever having an elongated shank forming a handle and two distal fingers extending angularly therefrom, one of the fingers including a distal end at generally a right angle to the longitudinal axis of the shank and a claw in spaced relationship thereto for simultaneously engaging upper and lower surfaces of one tab, thereby to bend the one tab upward upon movement of the lever, and the other finger extending slightly beyond the one finger for engaging the upper surface of the one tab, thereby to bend the one tab downward upon movement of the lever, the distal end of the one finger engaging the upper surface of the one tab to provide a fulcrum for the movement of the lever to bend the one tab upward and engaging the upper surface of a tab opposed to the one tab to provide a fulcrum for movement of the lever to bend the one tab downward.

* * * * *